US008093480B2

(12) United States Patent
Yoshida

(10) Patent No.: US 8,093,480 B2
(45) Date of Patent: Jan. 10, 2012

(54) KEYBOARD DEVICE FOR ELECTRONIC KEYBOARD INSTRUMENT

(75) Inventor: Koji Yoshida, Hamamatsu (JP)

(73) Assignee: Kabushiki Kaisha Kawai Gakki Seisakusho, Shizuoka (JP)

( * ) Notice: Subject to any disclaimer, the term of this patent is extended or adjusted under 35 U.S.C. 154(b) by 143 days.

(21) Appl. No.: 12/769,060

(22) Filed: Apr. 28, 2010

(65) Prior Publication Data

US 2010/0282049 A1 Nov. 11, 2010

(30) Foreign Application Priority Data

May 7, 2009 (JP) ..... 2009-112661

(51) Int. Cl.
*G10C 3/12* (2006.01)

(52) U.S. Cl. ..... 84/439

(58) Field of Classification Search ..... 84/439
See application file for complete search history.

(56) References Cited

U.S. PATENT DOCUMENTS

| | | | | | |
|---|---|---|---|---|---|
| 1,586,258 | A | * | 5/1926 | Mills | 84/439 |
| 2,999,411 | A | * | 9/1961 | Rice | 84/439 |
| 3,903,780 | A | * | 9/1975 | Aliprandi | 84/433 |
| 4,217,803 | A | * | 8/1980 | Dodds | 84/687 |
| 4,667,563 | A | * | 5/1987 | Wakuda et al. | 84/439 |
| 4,856,407 | A | * | 8/1989 | Katsuta et al. | 84/439 |
| 4,860,630 | A | * | 8/1989 | Franz et al. | 84/439 |
| 4,890,533 | A | * | 1/1990 | Katsuta et al. | 84/439 |
| 4,993,305 | A | * | 2/1991 | Franz et al. | 84/439 |
| 5,204,486 | A | * | 4/1993 | Kim et al. | 84/439 |
| 5,249,497 | A | * | 10/1993 | Niitsuma | 84/247 |
| 5,696,340 | A | * | 12/1997 | Ragni | 84/423 R |
| 5,895,875 | A | * | 4/1999 | Osuga et al. | 84/423 R |
| 6,147,290 | A | * | 11/2000 | Uno | 84/433 |
| 6,930,234 | B2 | * | 8/2005 | Davis | 84/423 R |
| 7,402,741 | B2 | * | 7/2008 | Funaki et al. | 84/423 R |
| 7,582,821 | B2 | * | 9/2009 | Watanabe | 84/423 R |
| 2008/0307944 | A1 | * | 12/2008 | Watanabe | 84/433 |
| 2010/0282049 | A1 | * | 11/2010 | Yoshida | 84/744 |

FOREIGN PATENT DOCUMENTS

| | | |
|---|---|---|
| JP | 3767153 | 4/2006 |
| JP | 3862858 | 12/2006 |

* cited by examiner

*Primary Examiner* — Elvin G Enad
*Assistant Examiner* — Robert W Horn
(74) *Attorney, Agent, or Firm* — Christie, Parker & Hale LLP

(57) ABSTRACT

A keyboard device for an electronic keyboard instrument, which has a simple construction and can be manufactured at relatively low costs, and is capable of providing let-off feeling closely analogous to the let-off feeling of an acoustic piano. The keyboard device comprises keys, hammers each of which has an engaging part and pivotally moves in accordance with pivotal motion of an associated key, an unmovable holder, and let-off members each formed of an elastic material, for temporary engagement with the engaging part of an associated hammer during each of key depression and key release, to impart let-off feeling to touch feeling of an associated key during key depression. Each let-off member extends from the holder to a pivotal path along which the associated hammer performs pivotal motion, and is compressed during key depression and deflected during key release by engagement with the engaging part.

13 Claims, 8 Drawing Sheets

FIG. 2
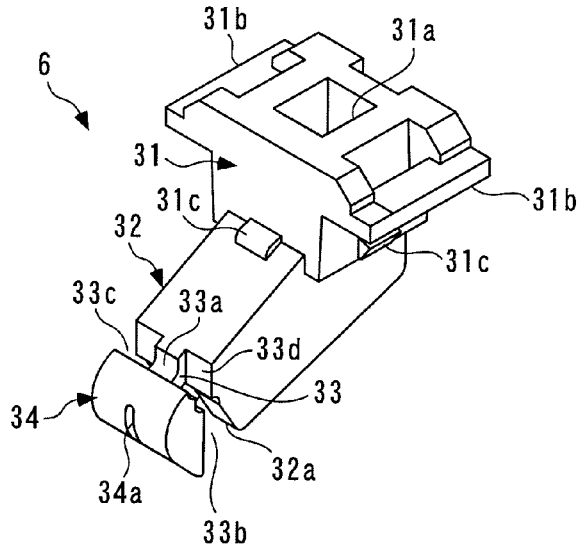
FIG. 3A
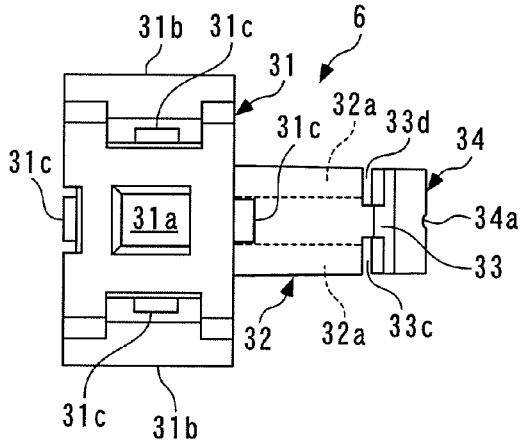
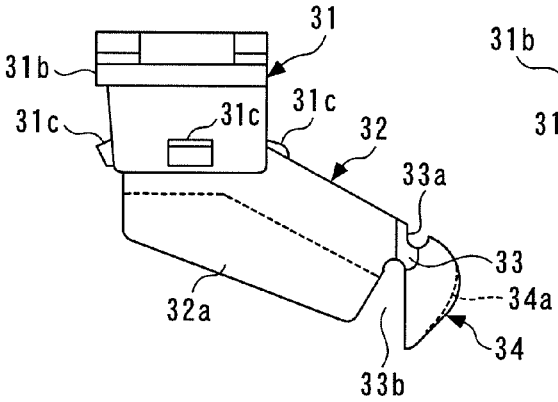
FIG. 3B
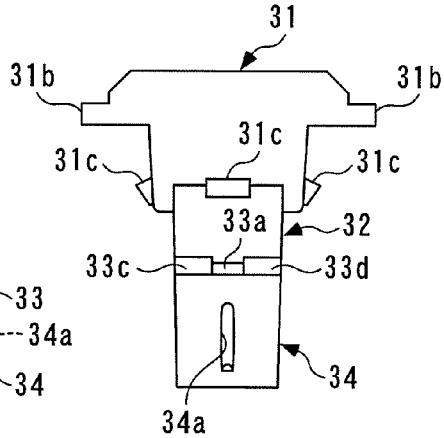
FIG. 3C

F I G. 8
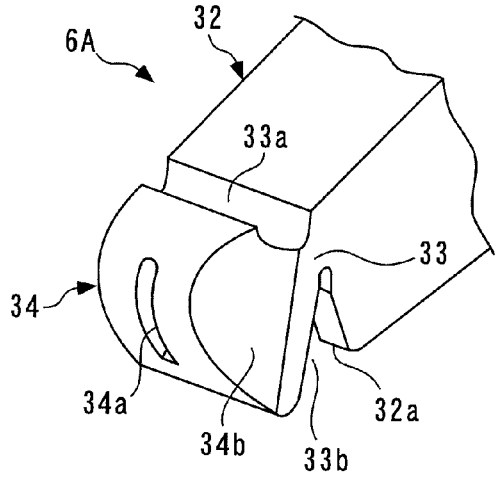
F I G. 9A
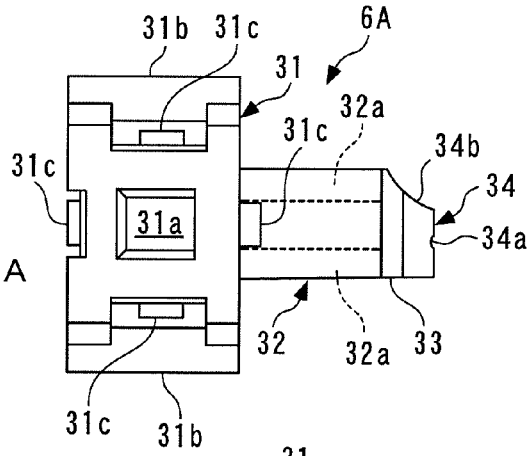
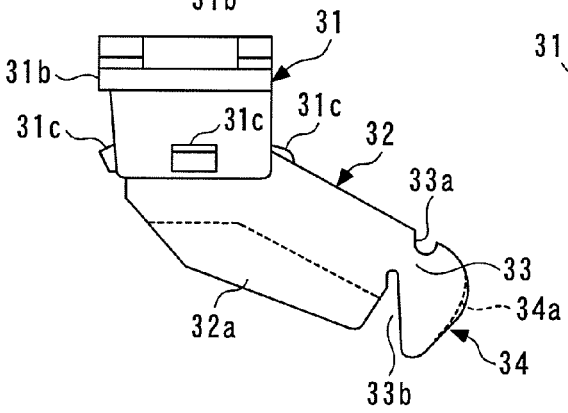
F I G. 9B
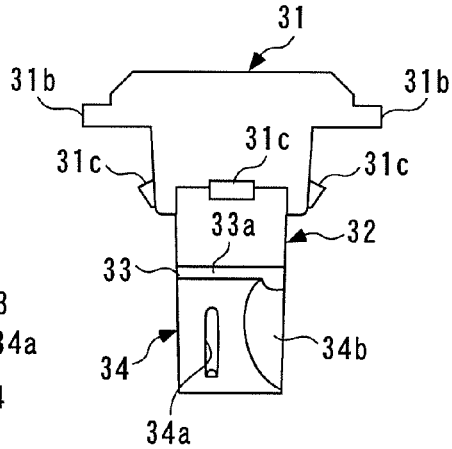
F I G. 9C

KEYBOARD DEVICE FOR ELECTRONIC KEYBOARD INSTRUMENT

CROSS-REFERENCE TO RELATED APPLICATION

This application claims priority of Japanese Patent Application Number 112661/2009, filed on May 7, 2009.

BACKGROUND OF THE INVENTION

1. Field of the Invention

The present invention relates to a keyboard device for an electronic keyboard instrument, which is applied to an electronic keyboard instrument, such as an electronic piano, and has a let-off function of giving let-off feeling closely analogous to that of an acoustic piano.

2. Description of the Related Art

A general acoustic piano is constructed such that changes in the touch weight (static load) of each key during key depression, more specifically, a sharp increase in the touch weight and a sharp reduction in the same immediately after the increase, occur to add a so-called let-off feeling to a touch feeling felt by the player while playing the piano. The touch feeling of each key is important in playing the piano and particularly in achieving musical performance rich in expression. Therefore, in an electronic keyboard instrument, such as an electronic piano, it is preferable to obtain touch feeling similar to that of an acoustic piano. For this reason, keyboard devices having a let-off function of giving let-off feeling have been developed for various kinds of electronic keyboard instruments, and as such a keyboard device, there have conventionally been known ones disclosed e.g. in Japanese Patent Publications No. 3862858 and No. 3767153.

The keyboard device disclosed in Japanese Patent Publication No. 3862858 includes a plurality of keys arranged side by side in the left-right direction and each having a rear end thereof pivotally supported, a plurality of hammers provided below the respective keys in association therewith such that each of the hammers can pivotally move vertically in accordance with key depression and key release in one keystroke of an associated key, and let-off units each disposed behind an associated key and an associated hammer to add a let-off feeling to the touch feeling of the key. Each of the let-off units includes a jack projecting toward an associated hammer, a jack holder which pivotally supports the jack and is pivotally supported itself, and first and second elastic members for urging the jack and the jack holder, respectively, in respective predetermined directions.

In the keyboard device, when a key is depressed, an associated hammer pivotally moves upward in accordance with the key depression and comes into contact and engagement with an associated jack from below. In this case, the jack pivotally moves rearward against the urging force of the first elastic member in one piece with an associated jack holder. When the hammer further moves upward, the engagement with the jack is released. When the hammer is thus brought into temporary engagement with the jack during key depression, a load temporarily acts on the hammer in an opposite direction to a direction of the pivotal motion of the hammer, whereby the touch weight of the key is sharply increased and then sharply reduced. Thus, a let-off feeling is added to the touch feeling. When the key is released after the key depression, the hammer pivotally moves downward in accordance with the key release to return to its original position. In this case, the hammer comes into contact and engagement with the jack from above during the pivotal return motion. As a consequence, the jack pivotally moves downward against the urging force of the second elastic member, and the hammer further moves downward, whereby the engagement with the jack is released.

On the other hand, the keyboard device disclosed in Japanese Patent Publication No. 3767153 includes a plurality of keys and hammers similar to those in Japanese Patent Publication No. 3862858, and leaf springs each disposed reward of associated ones of these on a hammer-by-hammer basis to add a let-off feeling to the touch feeling of the key. The leaf spring extends horizontally in the front-rear direction and has a rear end thereof fixed to a mount having a predetermined shape. Specifically, the mount has first and second supports in contact with the respective upper and lower surfaces of the leaf spring, and the first support is formed at a predetermined location closer to the front end of the leaf spring as a free end thereof than the second support is.

In this keyboard device, when a key is depressed, an associated hammer pivotally moved upward in accordance with the key depression comes into contact and engagement with the front end of the leaf spring from below. In this case, the leaf spring is deflected upward using the first support as a support, and the hammer further pivotally moves upward, whereby the engagement with the leaf spring is released. When the hammer is thus brought into temporary engagement with the leaf spring during key depression, the touch weight of the key is sharply increased and then sharply reduced similarly to the keyboard device disclosed in Japanese Patent Publication No. 3862858, whereby a let-off feeling is added to the touch feeling. When the key is released after the key depression, the hammer pivotally moves downward in accordance with the key release to return to its original position. In this case, the hammer comes into contact and engagement with the front end of the leaf spring from above during the pivotal return motion. As a consequence, the leaf spring is deflected downward using the second support as a support differently from the case where the key is depressed, and the hammer further pivotally moves downward, whereby the engagement with the leaf spring is released.

In the keyboard device disclosed in Japanese Patent Publication No. 3862858, since the let-off unit for giving let-off feeling comprises the jack and the jack holder connected to each other in a pivotally movable manner, the first and second elastic members, and so forth as described hereinbefore, the total number of component parts is large, and the construction is complicated, which causes an increase in manufacturing costs of the keyboard device. On the other hand, in the keyboard device disclosed in Japanese Patent Publication No. 3767153, since the leaf spring is deflected upward and downward using the respective different supports by key depression and key release, long-term use can reduce the resilience of the leaf spring obtained by deflection or deform the leaf spring, depending on the material of the leaf spring. In such a case, there is a fear that it is impossible to obtain sufficient let-off feeling in appropriate timing during key depression.

SUMMARY OF THE INVENTION

It is an object of the present invention to provide a keyboard device for an electronic keyboard instrument, which has a simple construction and can be manufactured at relatively low costs, and is capable of stably providing let-off feeling closely analogous to the let-off feeling of an acoustic piano for a long time.

To attain the above object, the present invention provides a keyboard device for an electronic keyboard instrument provided with a let-off function of giving let-off feeling closely analogous to let-off feeling of an acoustic piano, comprising a plurality of keys arranged side by side in a left-right direction such that each of the keys can perform pivotal motion, the key pivotally moving in opposite directions during key depression and during key release, respectively, a plurality of hammers each having an engaging part and provided for an associated one of the keys such that the hammer can perform pivotal motion, the hammer pivotally moving in accordance with pivotal motion of the key, an unmovable holder, and a plurality of let-off imparting members each formed of an elastic material and mounted to the holder for an associated one of the hammers such that the engaging part of the hammer can come into temporary engagement with the let-off imparting member during pivotal motion of the hammer caused by each of key depression and key release, the let-off imparting member imparting let-off feeling to touch feeling of the associated key during key depression, wherein each of the let-off imparting members extends from the holder toward a pivotal path along which the engaging part of the hammer pivotally moves, and is positioned such that the let-off imparting member is compressed during key depression and is deflected during key release, by engagement with the engaging part during pivotal motion of the hammer.

With this arrangement, the key pivotally moves in opposite directions during key depression and key release in a single keystroke, respectively, and the associated hammer pivotally moves in accordance with the pivotal motion of the key. Further, the engaging part of the hammer comes into temporary engagement with the associated let-off imparting member both during pivotal motion of the hammer caused by key depression and during pivotal motion of the same caused by key release. This let-off imparting member is formed of an elastic material and extends from the holder to which it is mounted toward the pivotal path along which the engaging part of the hammer pivotally moves. The let-off imparting member is compressed during key depression and deflected during key release by engagement with the engaging part in accordance with pivotal motion of the hammer.

Thus, during key depression, since the pivotally moving hammer comes into engagement with the let-off imparting member to compress the same, a resilient force of the let-off imparting member is generated as a reaction, and acts on the hammer. As a consequence, the pivotal motion of the hammer is restricted, and the touch weight of the key is sharply increased due to rotational resistance generated at this time. Then, when the hammer further pivotally moves and releases the engagement with the let-off imparting member, the rotational resistance is lost, whereby the touch weight of the key is sharply reduced. The sharp increase and decrease in the touch weight adds a let-off feeling to the touch feeling of the key. On the other hand, during key release, the hammer pivotally moved by key depression as described above comes into temporary engagement with the let-off imparting member during pivotal return motion to its original position, to deflect the same. In this case, rotational resistance which acts on the hammer from the let-off imparting member is much smaller than the rotational resistance caused by the resilient force of the let-off imparting member compressed during key depression. Therefore, even when the hammer is brought into engagement with the let-off imparting member during its pivotal return motion, the pivotal motion of the hammer is hardly restricted, so that the hammer can perform quick pivotal return motion, and in accordance with the pivotal motion of the hammer, the associated key can also quickly return to its original position where it was before the key depression.

Thus, it is possible to add a let-off feeling to the touch feeling of the key using the let-off imparting member having a relatively simple construction, so that the keyboard device having the let-off function of giving a let-off feeling closely analogous to that of an acoustic piano can be manufactured without making its construction complicated and at relatively low costs. Further, since the let-off feeling can be obtained by compressing the let-off imparting member by the hammer, it is possible to obtain the let-off feeling more stably over a longer time period in comparison with the conventional keyboard device in which a let-off feeling is obtained by bending a leaf spring.

Preferably, each of the hammers is configured to pivotally move about an axis extending in the left-right direction, upward during key depression and downward during key release, and each of the let-off imparting members has a body part extending toward the pivotal path, the body part being positioned such that an upper one of angles formed by a center line of the body part and a tangent to the pivotal path at a position where the engaging part of the hammer comes into engagement therewith is smaller than a lower one of the angles.

With this arrangement, the hammer pivotally moves about the axis extending in the left-right direction, upward during key depression and downward during key release. Further, the body part of the let-off imparting member mounted to the holder extends toward the pivotal path of the engaging part of the hammer, and is positioned such that the upper one of the angles formed by the center line of the body part and the tangent to the pivotal path at the position where the engaging part of the hammer comes into engagement therewith is smaller than the lower one of the angles. Since the body part of the let-off imparting member is thus positioned with respect to the hammer, it is possible to easily realize the compression of the let-off imparting member by the hammer during key depression and deflection of the same during key release.

More preferably, each of the let-off imparting members further comprises a head part formed at an extreme end of the body part by way of a neck part smaller in cross section than the body part, for engagement with the engaging part of the hammer.

With this arrangement, the let-off imparting member has the head part formed at the extreme end of the body part by way of the neck part, for engagement with the engaging part of the pivotally moving hammer. Therefore, when an external force acts on the head part, the neck part is easily bent, and the head part is easily tilted from the body part.

When the engaging part of the pivotally moving hammer comes into engagement with the head part of the let-off imparting member during key depression, an external force from the hammer acts to press the head part of the let-off imparting member and press the body part as well via the neck part. Immediately after the pressing, the engaging part of the hammer pushes the head part of the let-off imparting member upward to tilt the head part upward from the body part, whereby the engagement with the head part is released. Since the head part is easily tilted upward from the body part as described above, the engaging part of the hammer engaged with the head part smoothly disengages itself from the head part. The engagement and disengagement between the hammer and the let-off imparting member makes it possible to obtain stable let-off feeling without key-dependent variation.

On the other hand, when the engaging part of the hammer comes into engagement with the head part of the let-off imparting member during key release, the external force from the hammer acts to cause deflection in the neck part. More specifically, the engaging part of the hammer engaged (brought into contact) with the head part of the let-off imparting member pushes the head part downward to tilt the same downward from the body part and smoothly disengage itself from the head part. Thus, the hammer having come into engagement with the let-off imparting member during key release is smoothly and quickly disengaged from the let-off imparting member while receiving little rotational resistance from the let-off imparting member, which ensures that the hammer and the key perform quick pivotal return motion.

Further preferably, each of the let-off imparting members has an upper slit formed above the neck part and a lower slit formed below the neck part, and the lower slit is deeper than the upper slit and has a width increasingly broadened downward.

With this arrangement, since the upper and lower slits are formed above and below the neck part of the let-off imparting member, respectively, the neck part is easily bent upward and downward immediately after the engaging part of the hammer has come into engagement with the head part of the let-off imparting member, which ensures quick release of the engagement between the two. In particular, since the lower slit is deeper than the upper slit and has a width increasingly broadened downward, larger deflection is caused in the neck part when the hammer pivotally moving downward during key release comes into engagement with the let-off imparting member. This makes it possible to obtain the same advantageous effects as described above.

Even more preferably, each of the let-off imparting members has a left slit formed at a location leftward of the neck part and a right slit formed at a location rightward of the neck part.

With this arrangement, since the left and right slits are formed at the locations leftward and rightward of the neck part of the let-off imparting member, respectively, the neck part is easily bent not only upward and downward, but also leftward and rightward when the engaging part of the hammer has come into engagement with the head part of the let-off imparting member, which ensures quick release of the engagement between the two. This makes it possible to further effectively obtain the same advantageous effects as described above.

Even more preferably, the head part of each of the let-off imparting members has one of a left half thereof and a right half thereof cut out.

With this arrangement, when the engaging part of the hammer has come into engagement with the head part of the let-off imparting member, the neck part is easily deflected not only upward and downward, but also at a non-cut out portion, which ensures quick release of the engagement between the two. This makes it possible to further effectively obtain the same advantageous effects as described above.

More preferably, each of the hammers extends in a front-rear direction and has a rear end thereof pivotally supported, and the engaging part projects upward from a longitudinal center of the hammer.

With this arrangement, since the engaging part projects upward from the longitudinal center of the hammer, it is possible to mount the let-off imparting member more easily without making a large change in design of the hammer and its neighborhood, such that a let-off feeling can be obtained in appropriate timing during key depression, in comparison with a case where the engaging part is formed at a location close to a support about which the hammer performs pivotal motion or to an extreme end of the same.

Further preferably, the body part of each of the let-off imparting members has a pair of left and right ribs each extending along a length of the body part and projecting downward, the pair of left and right ribs being disposed in a manner spaced from each other in the left-right direction.

With this arrangement, the body part of the let-off imparting member has the pair of left and right ribs extending longitudinally and projecting downward, and hence it is possible to make the body part difficult to bend in the vertical direction. For example, if the body part can be easily bent in the vertical direction, not only the neck part but also the body part is bent when the engaging part of the hammer pivotally moving during key depression comes into engagement with the head part of the let-off imparting member and then disengages itself from the same. As a consequence, disengagement timing can be delayed, which sometimes makes it impossible to obtain a stable let-off feeling. Therefore, by providing the ribs constructed as above on the body part, the engaging part thereof disengages itself from the head part of the let-off imparting member in appropriate timing after engagement with the same, which makes it possible to obtain a stable let-off feeling.

Further preferably, the engaging part of each of the hammers has a larger lateral width than the head part of the let-off imparting member does.

With this arrangement, the engaging part of the pivotally moving hammer is brought into engagement with the head part of the let-off imparting member over the entire lateral width of the head part. As a consequence, the head part of the let-off imparting member performs the same predetermined operation from the start of engagement with the engaging part of the hammer to disengagement from the same in every keystroke, and hence it is possible to obtain the same stable let-off feeling in every keystroke. Further, even if the mounting position of the let-off imparting member slightly deviates from a proper position in the left-right direction, it is possible to secure the engagement between the head part of the let-off imparting member and the engaging part of the hammer while accommodating the mounting error.

Further preferably, the body part of each of the let-off imparting members has a higher hardness than the neck part and the head part do.

With this arrangement, the body part of the let-off imparting member has a higher hardness than the neck part and the head part, and hence it is possible to mount the let-off imparting member to the holder securely and stably by mounting the body part to the holder and improve the mounting accuracy.

Preferably, the holder and the let-off imparting members are integrally formed, and the holder is formed of a predetermined hard material harder than a material of the let-off imparting members.

With this arrangement, the holder and the let-off imparting members are integrally formed, and hence it is possible to improve manufacturing efficiency in comparison with a case where the holder and the let-off imparting members are manufactured separately and then the let-off imparting members are mounted to the holder. More specifically, a molded article in which the let-off imparting members are supported by the holder can be manufactured with high efficiency. Further, since the holder is formed of a hard material harder than a material of the let-off imparting members, it is possible to dispose the holder stably in an unmovable state to thereby ensure that the let-off imparting members are positioned at respective appropriate locations.

Preferably, the holder has a plurality of mounting holes formed therein in a manner arranged with a predetermined space between each adjacent two in association with the respective hammers, and the let-off imparting members are integrally molded such that the let-off imparting members are each connected via a connecting part formed of a flexible material and having a predetermined length larger than the predetermined space, in a manner adjacent to one another, and each of the let-off imparting members is mounted to the holder via an associated one of the mounting holes.

With this arrangement, the holder has the mounting holes formed therein in a manner arranged in association with the respective hammers and with a predetermined space between each adjacent two. Further, the let-off imparting members are integrally molded such that they are each connected via the connecting part, in a manner adjacent to one another. In the molded article (hereinafter referred to as "the let-off member set") having a plurality of let-off imparting members integrally molded as a set, the connecting part connecting between each adjacent two of the let-off imparting members is formed of a flexible material and has a predetermined length larger than the predetermined space between the mounting holes of the holder adjacent to each other. By employing the let-off member set, e.g. when the distance between the adjacent mounting holes of the holder differs depending on the model of an electronic keyboard instrument or when the distance is changed due to a change in design or the like, it is possible to bend the connecting part between each adjacent two of the let-off imparting members, as desired, according to the distance between the mounting holes, whereby each of the let-off imparting members of the let-off member set can be mounted in the holder via an associated mounting hole while adjusting the distance between the let-off imparting members. This makes it possible to attain commonality of the let-off member set among electronic keyboard instruments different in model and flexibly cope with a change in the distance between the mounting holes of the holder.

More preferably, the integrally molded let-off imparting members are formed as a molded article having a predetermined number of the let-off imparting members smaller in number than a total number of the mounting holes in the holder.

With this arrangement, the let-off member set has a predetermined number of the let-off imparting members smaller in number than the total number of the mounting holes in the holder, and hence it is possible to provide a plurality of let-off member sets according to the number of let-off imparting members to be mounted to the holder, to thereby mount a required number of let-off imparting members to the holder. Further, since the number of the let-off imparting members of the let-off member set is smaller than the total number of the mounting holes in the holder, it is possible to make the let-off member set more compact than in the case where the same number of let-off imparting members as the total number of the mounting holes are integrally formed. This makes it easy to store and handle let-off member sets.

The above and other objects, features, and advantages of the present invention will become more apparent from the following detailed description taken in conjunction with the accompanying drawings.

BRIEF DESCRIPTION OF THE DRAWINGS

FIG. 2 is a perspective view of a let-off member;

FIG. 3A is a plan view of the let-off member;

FIG. 3B is a left side view of the let-off member;

FIG. 3C is a front view of the let-off member;

FIGS. 5A to 5C are views showing a sequence of operations of key depression and key release in a single keystroke, in which:

FIG. 5A shows a state in which a hammer has come into engagement with an associated let-off member during key depression;

FIG. 5B shows a state in which the hammer has disengaged itself from the let-off member during key depression; and FIG. 5C shows a state in which the hammer has come into engagement with the let-off member during key release;

FIG. 8 is a perspective view of a variation of the let-off member;

FIG. 9A is a plan view of the let-off member in FIG. 8;

FIG. 9B is a left side view of the let-off member in FIG. 8;

FIG. 9C is a front view of the let-off member in FIG. 8; and

FIGS. 10A and 10B are views useful in explaining a let-off member set formed by a set of a plurality of let-off members, in which:

FIG. 10A shows a state of the let-off member set before being mounted to a holder; and FIG. 10B shows a state of the let-off member set mounted to the holder.

DETAILED DESCRIPTION OF PREFERRED EMBODIMENTS

The present invention will now be described in detail with reference to the drawings showing a preferred embodiment thereof. FIG. 1 shows a keyboard device for an electronic piano, according to the embodiment of the present invention, in a key-released state. The keyboard device 1 has a let-off function of giving let-off feeling closely analogous to that of an acoustic piano, during musical performance.

Now, a brief description will be given of how a let-off feeling is caused in a touch feeling of a grand piano as an acoustic piano. In a grand piano, when depression of a key is started, the key, an associated action, and so forth pivotally move together, whereby the touch weight of the key is gently increased. When the key is pushed downward by a certain amount, the jack of the action is brought into abutment with an associated regulating button, whereby the pivotal motion of the action is restrained. At this time, the touch weight of the key sharply increases due to the rotational resistance. Then, a let-off operation, which is an operation that the jack pushes an associated hammer upward and then disengages itself from a repetition lever, causes the rotational resistance to disappear, whereby the touch weight of the key is sharply reduced. Thereafter, when the key reaches its lower limit position where the key is completely pushed down, the touch weight of the key sharply increases again. A sense caused by the changes in the touch weight during key depression, particularly caused by the sharp increase and decrease of the touch weight before and after the let-off operation, is felt by the player, as a let-off feeling in touch feeling.

Figure 1A:
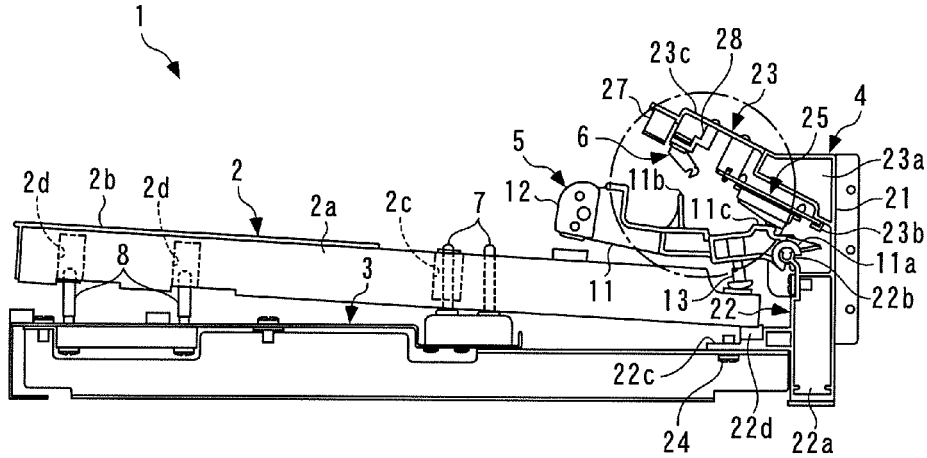
FIG. 1A is a side view of a keyboard device for an electronic piano, according to an embodiment of the present invention, in a key-released state.

As shown in FIG. 1A, the keyboard device 1 includes a plurality of keys 2 (only one white key of which is shown, with representation of a black key omitted) arranged side by side in a left-right direction (front-rear direction as viewed in FIG. 1A), a keyboard chassis 3 for supporting the keys 2 from below, an action chassis 4 connected to the rear end (right end as viewed in FIG. 1A) of the keyboard chassis 3, for supporting an associated action (including a hammer 5 and a key switch 25, referred to hereinafter) for transmitting key depression information on an associated key 2 to a control device (not shown), a plurality of hammers 5 (only one of which is shown) provided for the respective keys 2 and pivotally supported by the action chassis 4, and a plurality of let-off members 6 (let-off imparting members) (only one of which is shown) each provided for an associated one of the hammers 5 and for adding the let-off feeling to the touch feeling of the associated key 2.

The keyboard chassis 3 is formed by assembling press-punched and bent metal plates or the like in parallel crosses. The keyboard chassis 3 is secured on a keybed, not shown. On a central part of the keyboard chassis 3 in the front-rear direction of the keyboard device 1 (i.e. in the left-right direction as viewed in FIG. 1A), a plurality of balance pins 7 are erected in a manner arranged side by side in the left-right direction of the keyboard device 1 (i.e. in the front-rear direction as viewed in FIG. 1A), and each of the balance pins 7 is loosely inserted in a balance pin hole 2*c*, referred to hereinafter, of an associated key 2. It should be noted that as for two balance pins 7 and 7 appearing in FIG. 1A, the front one (left one as viewed in FIG. 1A) is engaged in the white key 2, and the rear one is in the black key, not shown. Further, on a front end of the keyboard chassis 3, a pair of front and rear guide pins 8 and 8 are erected for each key 2, and the guide pins 8 and 8 are loosely inserted in respective guide pin holes 2*d* and 2*d*, referred to hereinafter, of the associated key 2.

Each of the keys 2 comprises a wooden key body 2*a* extending in the front-rear direction and having a rectangular cross section and a key cover 2*b* made of a synthetic resin and bonded to the front and top of a front half of the key body 2*a*. A central part of the key body 2*a* in the front-rear direction of the keyboard device 1 is formed with the balance pin holes 2*c*, and the key 2 is pivotally supported by the balance pins 7 via the balance pin holes 2*c*. A front end of the key body 2*a* is formed with the pair of front and rear guide pin holes 2*d* and 2*d*, and engagement between the guide pin holes 2*d* and 2*d* and the respective guide pins 8 and 8 prevents the key 2 from laterally swinging during a pivotal motion.

Each of the hammers 5 comprises a rod-like hammer body 11 extending in the front-rear direction and left and right weight plates 12 (only right one of which is shown) attached to the respective left and right side surfaces of the front end of the hammer body 11. The hammer body 11 is made of a synthetic resin, while the weight plates 12 are each made of a metal material, such as iron. The hammer body 11 has a rear end thereof formed with an arcuate bearing 11*a* open obliquely downward and rearward. The bearing 11*a* is engaged with a fulcrum support 22*b*, referred to hereinafter, of the action chassis 4, whereby the hammer 5 is supported on the action chassis 4 in a manner pivotally movable in a vertical direction.

Further, the hammer body 11 has a longitudinal center thereof formed with an engaging projection 11*b* (engaging part) projecting upward by a predetermined length in substantially orthogonal relation to the hammer body 11 and having a larger lateral dimension (e.g. of 10 mm) than that of a head part 34, referred to hereinafter, of the let-off member 6. As described hereinafter, the upper end of the engaging projection 11*b* comes into temporary engagement with the let-off member 6 during a pivotal motion of the hammer 5. Furthermore, the hammer body 11 has a rear end thereof formed with a switch pressing portion 11*c* having an upwardly convex shape at a location forward of the bearing 11*a*. On the other hand, in the lower surface of the rear end of the hammer body 11, there is screwed a capstan 13. The hammer 5 is placed on the upper surface of the rear end of the associated key 2 via the capstan 13.

The action chassis 4, which is formed by a hollow extrusion molded article of aluminum or the like metal material, extends over the length of all the hammers 5 in the left-right direction in which the keys 2 are arranged. The action chassis 4 is connected to the keyboard chassis 3 and secured on the keybed. The action chassis 4 includes a rear wall 21, a hammer supporting part 22 that cooperates with the rear wall 21 to form a hollow 22*a* extending vertically, and a switch mounting part 23 that extends forward and obliquely upward and cooperates with the rear wall 21 to form a right-triangular hollow 23*a* above the hammer supporting part 22.

The hammer supporting part 22 has a front upper end thereof formed with the arcuate fulcrum support 22*b* slightly projecting forward and obliquely upward and open upward. The bearing 11*a* of each hammer 5 is pivotally engaged with the fulcrum support 22*b*. Further, the hammer supporting part 22 has a chassis connecting part 22*c* extending forward from the central part of the front surface of the hammer supporting part 22 in a stair-stepped manner and placed on the rear end of the keyboard chassis 3. The action chassis 4 is connected to the keyboard chassis 3 by a plurality of connecting screws 24 (only one of which is shown) screwed in a front end of the chassis connecting part 22*c*. It should be noted that on the longitudinal center of the chassis connecting part 22*c*, a felt 22*d* for supporting the rear end of the lower surface of each key 2 in a key-released state from below extends over the length of all the keys 2 in the left-right direction of the keyboard device 1.

The key switch 25 for detecting key depression information on each key 2 is mounted on a hammer side of the switch mounting part 23. The key switch 25 comprises a switch board 25*a* formed by a printed board and switch bodies 25*b* each formed by a rubber switch and mounted on the hammer side of the switch board 25*a* for an associated one of the keys 2. The key switch 25 has the rear end of the switch board 25*a* inserted in an engaging recess 23*b* formed in the base part of the switch mounting part 23, and is screwed to a spacer 26 inserted between the front end of the switch board 25*a* and the switch mounting part 23.

Further, the switch mounting part 23 has an extension part 23*c* extending forward and obliquely upward from the hollow 23*a* and a stopper 27 formed e.g. of foamed urethane and provided on the front end of the hammer side of the extension part 23*c*, for restricting upward pivotal motion of the hammer 5. Furthermore, between the key switch 25 and the stopper 27 of the extension part 23*c* are provided the let-off members 6 via a holder 28 made of plastic (e.g. an ABS resin).

The holder 28 extends over the length of all the hammers 5 in the left-right direction. The holder 28 has a predetermined shape in cross section, and is screwed to the extension part 23*c* of the switch mounting part 23. Further, the holder 28 has a lower end formed with a plurality of mounting holes (see FIGS. 10A and 10B) arranged in the longitudinal direction of the holder 28 in association with the hammers 5, respectively. The let-off members 6 are mounted to the holder 28 via the respective mounting holes.

FIGS. 2 and 3A to 3C shows the let-off member 6. The let-off member 6 is formed by a predetermined-shaped molded article of a predetermined elastic material (e.g. styrene-based thermoplastic elastomer). As shown in FIGS. 2 and 3A to 3C, the let-off member 6 comprises a mounting part 31 for mounting the let-off member 6 to the holder 28, a body part 32 extending forward downwardly from the mounting part 31, and the head part 34 projecting from the body part 32 by way of a neck part 33.

The mounting part 31 is formed into a block shape having a hollow 31*a* open upward, and has engaging pieces 31*b* and 31*b* extending horizontally from the respective left and right sides of the upper end thereof and engaging protrusions 31*c* protruding forward, rearward, leftward, and rightward from the respective four sides of the lower end thereof. In a state where the let-off member 6 is mounted to the holder 28, the mounting part 31 is fitted through an associated mounting hole of the holder 28, with the engaging pieces 31*b* and the engaging protrusions 31*c* being engaged with the respective upper and lower edges of the mounting hole of the holder 28. Thus, the let-off member 6 is securely mounted to the holder 28.

The body part 32, which extends forward downwardly from the lower end of the mounting part 31 by a predetermined length, is formed such that the transverse cross section thereof is slightly reduced progressively toward its extreme end. Further, the body part 32 has a lower part thereof formed with a pair of left and right ribs 32*a* and 32*a* longitudinally extending along the body part 32 and projecting downward. The left and right ribs 32*a* and 32*a* extends in parallel with a space therebetween. This prevents vertical deflection of the body part 32.

The head part 34 is formed to have a predetermined lateral dimension (e.g. of 5 mm) and has a curved front surface which is forwardly convex. The head part 34 projects from an upper portion of the extreme end of the body part 32 by way of the neck part 33 having a smaller cross section than that of the body part 32. The neck part 33 has upper and lower surfaces formed, respectively, with an upper slit 33*a* open upward and a lower slit 33*b* open downward. The lower slit 33*b* has a larger depth than the upper slit 33*a*, and is formed such that the width thereof progressively increases toward its lower end open downward. Further, the let-off member 6 has a left slit 33*c* formed at a location leftward of the neck part 33 in a manner open leftward and a right slit 33*d* formed at a location rightward of the neck part 33 in a manner open rightward. The left slit 33*c* and the right slit 33*d* are formed such that they are bilaterally symmetrical with each other. It should be noted that a relatively shallow groove 34*a* formed in the extreme end surface of the head part 34 is used to hold lubricant, such as grease, applied to the extreme end surface of the head part 34 over a long time period, so as to maintain lubrication between the engaging projection 11*b* and the head part 34.

Figure 1B:
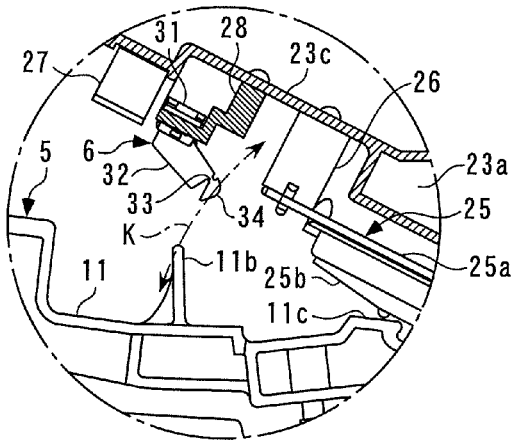
FIG. 1B is an enlarged view of a portion enclosed by a one-dot chain line circle in FIG. 1A.

In the keyboard device 1 constructed as above, the hammer 5 pivotally moves vertically about the fulcrum support 22*b* of the hammer supporting part 22 of the action chassis 4 in accordance with pivotal motion of the associated key 2 caused by a single keystroke. Specifically, the hammer 5 pivotally moves upward during key depression, and pivotally moves downward during key release after the key depression. At this time, the extreme end of the engaging projection 11*b* of the hammer 5 moves while traveling an arcuate path (hereinafter referred to as "the pivotal path K") with the fulcrum support 22*b* as its center, as shown in FIG. 1B, and the engaging projection 11*b* comes into temporary engagement with the extreme end of the let-off member 6, i.e. the head part 34, during the pivotal motion of the hammer 5.

Figure 4:
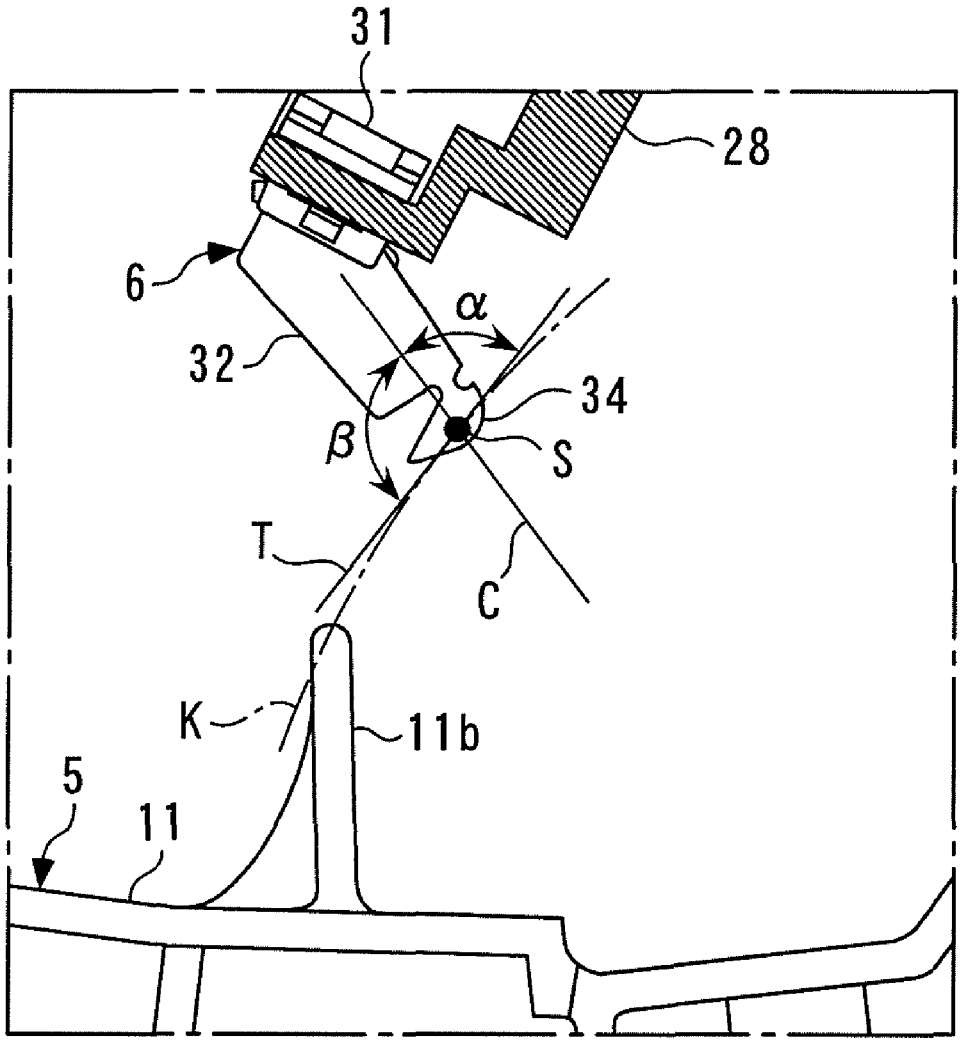
FIG. 4 is a view useful in explaining the positioning of the let-off member with respect to an engaging projection of an associated hammer.

FIG. 4 shows a state of positioning of the let-off member 6 with respect to the engaging projection 11*b* of the hammer 5. As shown in FIG. 4, in a state mounted to the holder 28 via the mounting part 31, the let-off member 6 is positioned such that the body part 32 extends toward the pivotal path K of the engaging projection 11*b* of the hammer 5, and the head part 34 projects slightly across the pivotal path K. In this case, the body part 32 of the let-off member 6 is in a position inclined such that between two angles $\alpha$ and $\beta$ formed by a center line C passing through the center of an external shape of cross-section of the body part 32 and a tangent T to the pivotal path K at a position where the head part 34 intersects the pivotal path K, i.e. a position where the extreme end of the engaging projection 11*b* of the hammer 5 comes into engagement with the head part 34, as a contact point S, there is a relationship that the upper angle $\alpha$ is smaller than the lower angle $\beta$.

Next, a description will be given of an operation caused by a single keystroke in the keyboard device 1 with reference to FIGS. 1A and 1B and 5A to 7. When a player depresses the key 2 by pushing a front end of the key 2 in the key-released state shown in FIGS. 1A and 1B, the key 2 pivotally moves about the balance pin 7 in the counterclockwise direction, as viewed in FIG. 1A. In accordance with this motion of the key 2, the hammer 5 is pushed upward via the capstan 13 to pivotally move about the fulcrum support 22*b* in the clockwise direction, as viewed in FIG. 1A. In this case, the touch weight of the key 2 gently increases as indicated by symbol A in FIG. 7. It should be noted that a keystroke represented by a horizontal axis in FIG. 7 indicates key push-down distance from a reference position corresponding to the height of the front end of the key 2 in the key-released state (i.e. before the start of key depression).

Figure 5A:
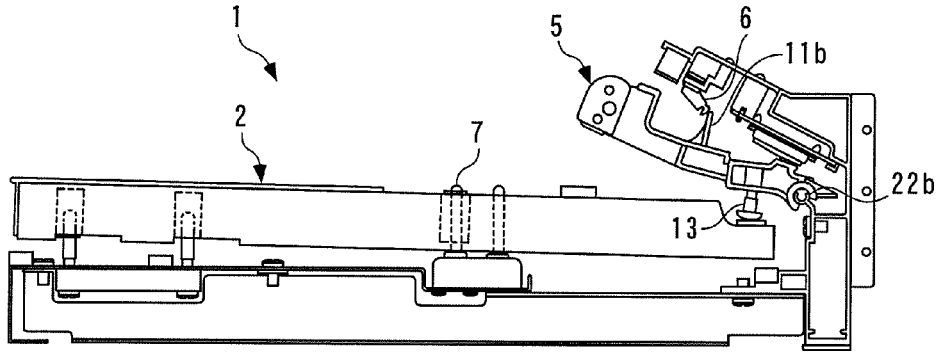
Figure 6A:
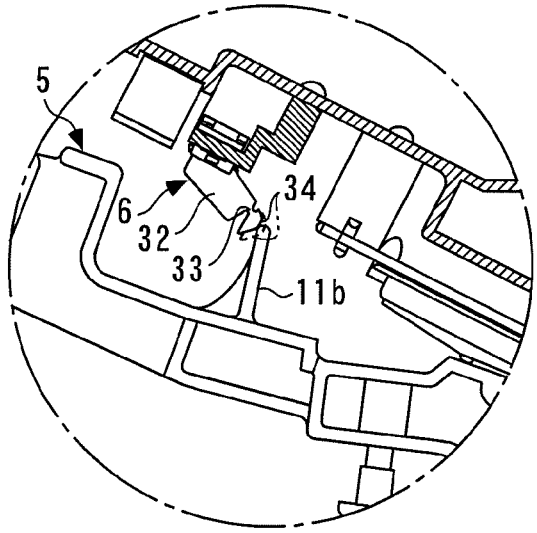
FIGS. 6A to 6C are enlarged views corresponding, respectively, to FIGS. 5A to 5C and showing the let-off member and component parts associated therewith.

When the key 2 is further depressed, the pivotal motion of the key 2 and that of the hammer 5 further advance, until the engaging projection 11*b* of the hammer 5 is brought into engagement with the let-off member 6 as shown in FIG. 5A. More specifically, the engaging projection 11*b* is brought into engagement with the head part 34 of the let-off member 6 as shown in FIG. 6A, to press the head part 34. Further, the engaging projection 11*b* presses the body part 32 via the neck part 33, whereby the let-off member 6 is compressed. At this time, a resilient force of the let-off member 6 is generated as a reaction, and acts on the hammer 5. As a consequence, the pivotal motion of the hammer 5 is restricted, and the touch weight of the key 2 is sharply increased due to rotational resistance generated at this time, as indicated by symbol B in FIG. 7.

Immediately after having pressed the let-off member 6, the engaging projection 11*b* of the hammer 5 pushes the head part 34 of the let-off member 6 upward to tilt the head part 34 upward from the body part 32, whereby engagement with the head part 34 is released. In this case, the upper and lower slits 33*a* and 33*b* and the left and right slits 33*c* and 33*d* formed in the let-off member 6 ensures a high degree of freedom in deflection of the neck part 33, so that the engaging projection 11*b* of the hammer 5 can be smoothly disengaged from the head part 34 of the let-off member 6.

Figure 5B:
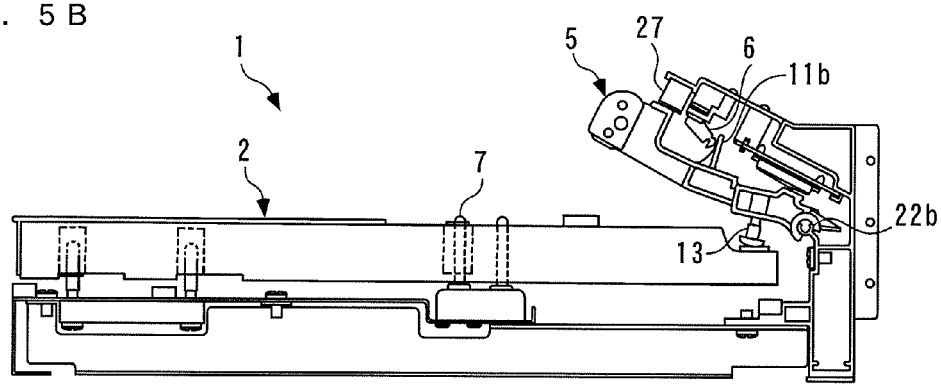
Figure 6B:
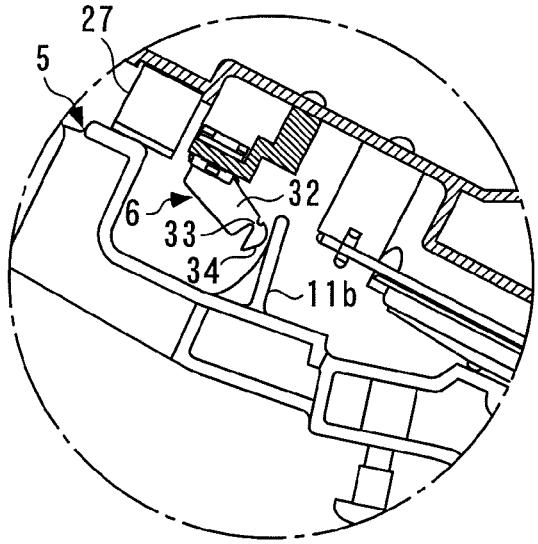

When the engaging projection 11*b* is disengaged from the head part 34, i.e. when the engagement between the engaging projection 11*b* and the head part 34 is released as shown in FIGS. 5B and 6B, the rotational resistance of the hammer 5 is lost. As a consequence, the touch weight of the key 2 is sharply reduced as indicated by symbol C in FIG. 7.

Thus, the touch weight of the key 2 during key depression is sharply changed by engagement and disengagement of the hammer 5 with and from the let-off member 6, whereby let-off feeling is added to the touch feeling of the key 2.

Thereafter, the hammer 5 comes into abutment with the stopper 27, and at approximately the same time, the key 2 reaches the lower limit pushed-down position, whereby the key depression is completed. In this case, since further pivotal motion of the key 2 is stopped, the touch weight of the key 2 is sharply increased again as indicated by symbol D in FIG. 7.

It should be noted that the above-described key depression causes the switch pressing portion 11*c* of the hammer 5 to press the switch body 25*b* of the key switch 25 to turn on, whereby key depression information on the key 2 is transmitted to the control device. Then, the control device controls the tone generation of the electronic piano based on the received key depression information.

Figure 5C:
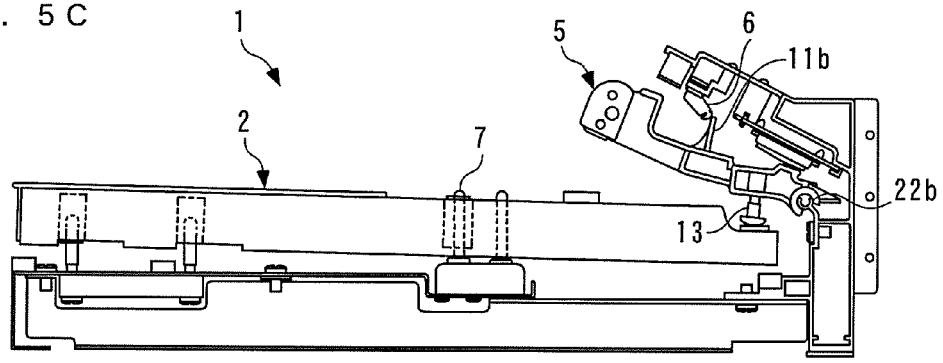
Figure 6C:
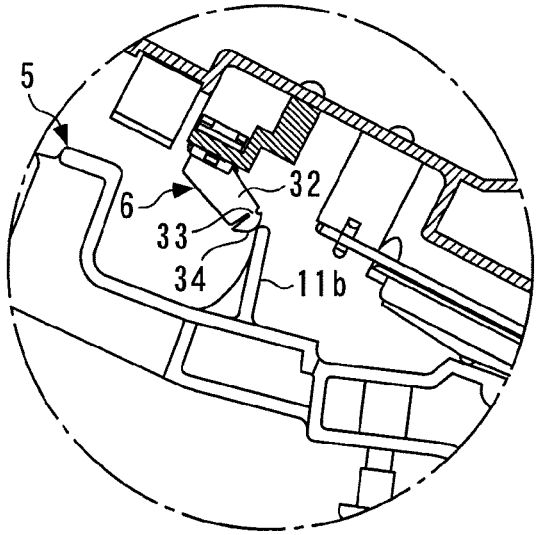

When the player removes a finger from the key 2 for key release in the state where the key depression has been terminated, the key 2 pivotally moves in the opposite direction to the direction of the pivotal motion performed during the key depression, to return to its original position shown in FIG. 1A. In accordance with this pivotal return motion of the key 2, the hammer 5 also performs pivotal return motion in the opposite direction to the direction of the pivotal motion performed during the key depression. In this case, the engaging projection 11*b* of the hammer 5 comes into engagement with the let-off member 6 during the pivotal return motion of the hammer 5 to its original position. More specifically, as shown in FIGS. 5C and 6C, the extreme end of the engaging projection 11*b* comes into contact with the head part 34 of the let-off member 6 obliquely from above to push the same downward. In this case, since the neck part 33 is easily deflected, the engaging projection 11*b* pushes the head part 34 downward, causing the head part 34 to be tilted downward from the body part 32, and thereby smoothly disengages itself from the head part 34.

Figure 7:
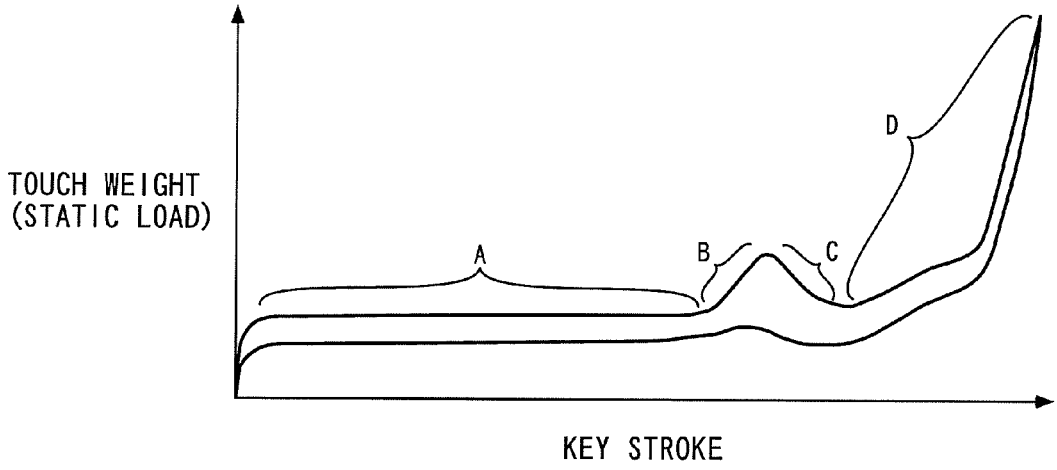
FIG. 7 is a diagram showing changes in touch weight which occur according to a keystroke during a time period from the start of key depression to the termination of key release.

As described above, the hammer 5 having come into engagement with the let-off member 6 during key release is smoothly and quickly disengaged from the let-off member 6 while receiving little rotational resistance from the let-off member 6, which ensures that the hammer 5 and the key 2 perform quick pivotal return motion. It should be noted that the touch weight of the key 2 during key release is generally smaller than during key depression as shown in FIG. 7, and it sharply decreases immediately after the start of key release, then gently decreasing.

As described above in detail, according to the present embodiment, the hammer 5 comes into temporary engagement with the let-off member 6 during respective pivotal motions of the hammer 5 caused by key depression and key release. In the case of key depression, the engaging projection 11*b* of the hammer 5 presses the head part 34 of the let-off member 6 to thereby compress the let-off member 6 and smoothly disengage itself from the head part 34 immediately after the pressing of the head part 34. As a consequence, the touch weight of the key 2 sharply increases, which makes it possible to add stable let-off feeling to the touch feeling of each key 2 without causing key-dependent variation in let-off feeling. In the present embodiment, the let-off members 6 having a relatively simple construction are employed so as to obtain such let-off feeling, so that the keyboard device 1 having the let-off function of giving a let-off feeling closely analogous to that of an acoustic piano can be manufactured without making its construction complicated and at relatively low costs. Further, in comparison with the conventional keyboard device in which let-off feeling is obtained by bending a leaf spring, it is possible to obtain more stable let-off feeling over a longer time period.

On the other hand, in the case of key release, the engaging projection 11*b* of the hammer 5 comes into contact with the head part 34 of the let-off member 6 obliquely from above and smoothly disengage itself from the head part 34 by bending the neck part 33. Therefore, even when the hammer 5 is brought into engagement with the let-off member 6 during its pivotal return motion, the pivotal motion of the hammer 5 is hardly restrained, so that the hammer 5 can perform quick pivotal return motion, and in accordance with the pivotal motion of the hammer 5, the associated key can also pivotally return to its original position where it was before the key depression.

Further, the engaging projection 11*b* of the hammer 5 projects upward from the longitudinal center of the hammer body 11, and the let-off member 6 is disposed between the key switch 25 and the stopper 27 in the switch mounting part 23. A conventional keyboard device which is of the same type as the keyboard device 1, but does not have the engaging projections 11*b* and the let-off members 6 has a relatively large space so as to ensure the pivotal motion of the hammer 5. In the keyboard device 1 of the present embodiment, the engaging projections 11*b* and the let-off members 6 are provided making use of the space, which makes it unnecessary to make a large change in the design of the hammers and their neighborhood, and it is possible to mount the let-off members 6 relatively easily such that let-off feeling can be obtained in appropriate timing during key depression.

Further, the engaging projection 11*b* of the hammer 5 has a larger lateral width than that of the head part 34 of the let-off member 6, so that the engaging projection 11*b* engages itself with the let-off member 6 over the entire lateral width of the head part 34. Since the head part 34 of the let-off member 6 performs the same predetermined motion over a time period from the start of engagement of the engaging projection 11*b* of the hammer 5 to disengagement of the same during each keystroke, it is possible to obtain the same stable let-off feeling without fail. Further, even if the mounting position of the let-off member 6 slightly deviates from a proper position in the left-right direction, it is possible to maintain the engagement between the head part 34 of the let-off member 6 and the engaging projection 11*b* of the hammer 5 while accommodating the mounting error.

FIGS. 8 and 9 show a variation of the let-off member 6. It should be noted that in FIGS. 8 and 9, the same parts as those of the let-off member 6 in FIGS. 2 and 3 are denoted by the same reference numerals, and detailed description thereof is omitted.

As shown in FIGS. 8 and 9, the let-off member 6A of the present variation is distinguished from the let-off member 6 in that the let-off member 6A does not have the left and right slits 33*c* and 33*d* of the neck part 33 and the head part 34 has a right half portion thereof cut out in an inwardly concave manner. Since the head part 34 is formed with such a cutout 34*b*, the neck part 33 is easy to be bent at a left-side portion, i.e. a portion opposite from the cutout 34*b* immediately after the engaging projection 11*b* of the hammer 5 comes into contact with the head part 34 during key depression. As a consequence, after having come into contact with the head part 34, the engaging projection 11*b* smoothly disengages itself from the head part 34. It is preferred that the cutout 34*b* is formed to have a lateral dimension larger than the width of each rib 32*a* formed as a lower portion of the body part 32 so as to sufficiently ensure the above-mentioned advantageous effect.

Figure 10A:
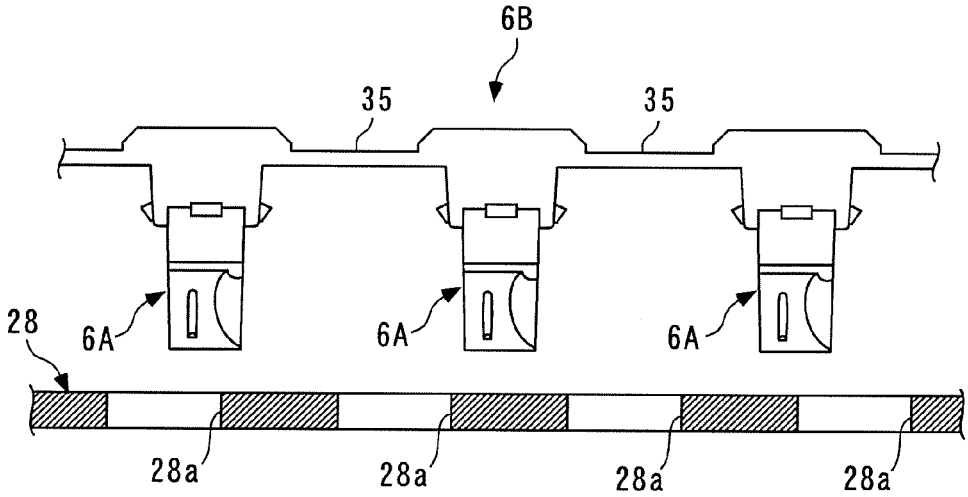

The let-off members 6 may be molded as a let-off member set comprised of a set of let-off members 6. FIG. 10A shows the let-off member set 6B molded such that a plurality of let-off members 6A (e.g. twelve let-off members 6A) are arranged side by side in the left-right direction. The let-off member set 6B is formed as a one-piece assembly by connecting each adjacent two of the let-off members 6A via a connecting part 35. The connecting part 35 is formed by a flexible material. The connecting part 35 has a predetermined length larger than the distance between two adjacent mounting holes 28*a* and 28*a* of the holder 28, and connects between engaging pieces 31*b* and 31*b* of the respective two let-off members 6A and 6A.

Figure 10B:
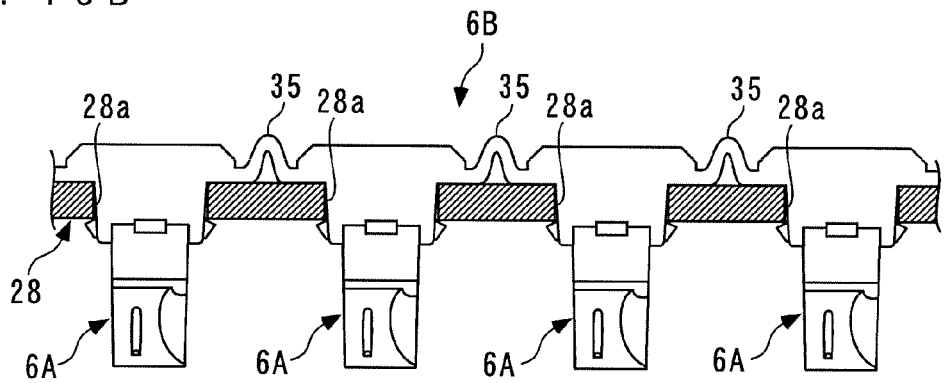

The let-off member set 6B constructed as above is mounted to the holder 28 with the let-off members 6A inserted in the respective associated mounting holes 28*a* from above as shown in FIG. 10B. In this case, each of the connecting parts 35 of the let-off member set 6B is longer than the distance between the adjacent mounting holes 28*a*, and therefore it is bent in an upwardly convex manner.

By employing the above-described let-off member set 6B, e.g. when the distance between the adjacent mounting holes 28*a* and 28*a* of the holder 28 differs depending on the model of an electronic piano, or when the distance is changed due to a design change or the like, it is possible to bend a connecting part 35 between each adjacent two of the let-off members 6A, as desired, according to the distance between associated adjacent mounting holes 28*a*, to thereby adjust the distance between the let-off members 6A and 6A and mount each of the let-off members 6A of the let-off member set 6B to the holder 28 via an associated mounting hole 28*a*. This makes it possible to make the let-off member set 6B common to electronic pianos different in model as well as flexibly ready for a change in the distance between the mounting holes 28*a* and 28*a* of the holder 28. Further, by reducing the number of the let-off members 6A in the single let-off member set 6B to a smaller number than the total number (e.g. 88) of the mounting holes 28*a* of the holder 28, it is possible to make the let-off member set 6B relatively compact so that the let-off member set 6B can be stored and handled with ease.

It should be noted that the present invention is not limited to the above-described embodiment, but can be practiced in various forms. Although in the present embodiment, the let-off members 6 and 6A of two different shapes for providing let-off feeling are disclosed, the shapes are by no means limitative, but it is possible to employ a let-off member of any shape insofar as it can be compressed during key depression and deflected during key release.

Further, in the holder 28 which has the let-off members 6 mounted thereto and is fixed to the extension part 23*c* by screws, each screw hole of the holder 28 may be formed e.g. into a slot shape extending in the front-rear direction so that the distance between each let-off member 6 and the pivotal path K of an associated hammer 5 can be changed. This makes it possible to easily adjust the magnitude of a sharp change in the touch weight, for causing let-off feeling.

Further, in the let-off member 6 (hereafter including the let-off member 6A), the body part 32 and the mounting part 31 may be formed of a material identical to or different from that of the neck part 33 and the head part 34 e.g. by double molding such that the body part 32 and the mounting part 31 have a higher hardness than that of the neck part 33 and the head part 34. This makes it possible to mount the let-off member 6 to the holder 28 securely and stably as well as to improve accuracy in the mounting.

Furthermore, the holder 28 and the let-off members 6 may be integrally formed. This makes it possible to make the manufacturing efficiency higher than when the holder 28 and the let-off members 6 are manufactured separately and then the let-off members 6 are mounted to the holder 28. In short, it is possible to efficiently manufacture a molded article having a plurality of let-off members 6 mounted to the holder 28. In this case, however, it is preferable that the holder 28 is formed of a hard material with a higher hardness than that of a material of the let-off members 6, e.g. by double molding. This makes it possible to mount the holder 28 stably such that it cannot be moved, to thereby ensure positioning of the let-off members 6 at respective appropriate locations.

Further, the details of the construction of the keyboard device 1 described in the embodiment is given only by way of example, and various changes and modifications may be made without departing from the spirit and scope of the present invention.

What is claimed is:

1. A keyboard device for an electronic keyboard instrument provided with a let-off function of giving let-off feeling closely analogous to let-off feeling of an acoustic piano, comprising:

a plurality of keys arranged side by side in a left-right direction such that each of said keys can perform pivotal motion, said key pivotally moving in opposite directions during key depression and during key release, respectively;

a plurality of hammers each having an engaging part and provided for an associated one of said keys such that said hammer can perform pivotal motion, said hammer pivotally moving in accordance with pivotal motion of said key;

an unmovable holder; and a plurality of let-off imparting members each formed of an elastic material and mounted to said holder for an associated one of said hammers such that said engaging part of said hammer can come into temporary engagement with said let-off imparting member during pivotal motion of said hammer caused by each of key depression and key release, said let-off imparting member imparting let-off feeling to touch feeling of said associated key during key depression, wherein each of said let-off imparting members extends from said holder toward a pivotal path along which said engaging part of said hammer pivotally moves, and is positioned such that said let-off imparting member is compressed during key depression and is deflected during key release, by engagement with said engaging part during pivotal motion of said hammer.

2. The keyboard device according to claim 1, wherein each of said hammers is configured to pivotally move about an axis extending in the left-right direction, upward during key depression and downward during key release, and wherein each of said let-off imparting members has a body part extending toward the pivotal path, said body part being positioned such that an upper one of angles formed by a center line of said body part and a tangent to the pivotal path at a position where said engaging part of said hammer comes into engagement therewith is smaller than a lower one of the angles.

3. The keyboard device according to claim 2, wherein each of said let-off imparting members further comprises a head part formed at an extreme end of said body part by way of a neck part smaller in cross section than said body part, for engagement with said engaging part of said hammer.

4. The keyboard device according to claim 3, wherein each of said let-off imparting members has an upper slit formed above said neck part and a lower slit formed below said neck part, and wherein the lower slit is deeper than the upper slit and has a width increasingly broadened downward.

5. The keyboard device according to claim 4, wherein each of said let-off imparting members has a left slit formed at a location leftward of said neck part and a right slit formed at a location rightward of said neck part.

6. The keyboard device according to claim 4, wherein said head part of each of said let-off imparting members has one of a left half thereof and a right half thereof cut out.

7. The keyboard device according to claim 2, wherein each of said hammers extends in a front-rear direction and has a rear end thereof pivotally supported, and wherein said engaging part projects upward from a longitudinal center of said hammer.

8. The keyboard device according to claim 3, wherein said body part of each of said let-off imparting members has a pair of left and right ribs each extending along a length of said body part and projecting downward, said pair of left and right ribs being disposed in a manner spaced from each other in the left-right direction.

9. The keyboard device according to claim 3, wherein said engaging part of each of said hammers has a larger lateral width than said head part of said let-off imparting member does.

10. The keyboard device according to claim 3, wherein said body part of each of said let-off imparting members has a higher hardness than said neck part and said head part do.

11. The keyboard device according to claim 1, wherein said holder and said let-off imparting members are integrally formed, and said holder is formed of a predetermined hard material harder than a material of said let-off imparting members.

12. The keyboard device according to claim 1, wherein said holder has a plurality of mounting holes formed therein in a manner arranged with a predetermined space between each adjacent two in association with said respective hammers, and wherein said let-off imparting members are integrally molded such that said let-off imparting members are each connected via a connecting part formed of a flexible material and having a predetermined length larger than the predetermined space, in a manner adjacent to one another, and each of said let-off imparting members is mounted to said holder via an associated one of the mounting holes.

13. The keyboard device according to claim 12, wherein said integrally molded let-off imparting members are formed as a molded article having a predetermined number of said let-off imparting members smaller in number than a total number of the mounting holes in said holder.

* * * * *